US010029714B2

(12) United States Patent
Seaton

(10) Patent No.: US 10,029,714 B2
(45) Date of Patent: Jul. 24, 2018

(54) LOCOMOTIVE HEALTH-BASED TRAIN PACING SYSTEM

(71) Applicant: Electro-Motive Diesel, Inc., LaGrange, IL (US)

(72) Inventor: James David Seaton, Westmont, IL (US)

(73) Assignee: Progress Rail Locomotive Inc., LeGrange, IL (US)

( * ) Notice: Subject to any disclaimer, the term of this patent is extended or adjusted under 35 U.S.C. 154(b) by 0 days.

(21) Appl. No.: 15/136,391

(22) Filed: Apr. 22, 2016

(65) Prior Publication Data

US 2017/0305446 A1 Oct. 26, 2017

(51) Int. Cl.
*B61L 15/00* (2006.01)
*B61L 27/00* (2006.01)
*B61L 25/02* (2006.01)

(52) U.S. Cl.
CPC ..... *B61L 15/0063* (2013.01); *B61L 25/021* (2013.01); *B61L 27/0011* (2013.01)

(58) Field of Classification Search
CPC . B61L 15/0063; B61L 25/021; B61L 27/0011
See application file for complete search history.

(56) References Cited

U.S. PATENT DOCUMENTS 7,219,067 B1 * 5/2007 McMullen ..... B61L 27/0011 246/122 R
8,583,299 B2 * 11/2013 Goodermuth ..... B60T 13/665 701/1
8,630,757 B2 1/2014 Daum et al.
8,676,410 B2 * 3/2014 Houpt ..... B61L 27/0027 701/19
8,805,605 B2 8/2014 Cooper et al.
2007/0219680 A1 9/2007 Kumar et al.
2009/0079560 A1 * 3/2009 Fries ..... B61L 27/0088 340/539.22
2011/0118899 A1 5/2011 Brooks et al.
2013/0289805 A1 10/2013 Makkinejad
2016/0292931 A1 * 10/2016 Chundru ..... G06Q 10/00

FOREIGN PATENT DOCUMENTS

WO 2012119197 9/2012

* cited by examiner

*Primary Examiner* — Todd Melton
(74) *Attorney, Agent, or Firm* — Finnegan, Henderson, Farabow, Garrett & Dunner, LLP

(57) ABSTRACT

A system for pacing a train having a plurality of locomotives is disclosed. The system may include an signaling system onboard component configured to receive a signal indicative of a requested time of arrival (RTA) of the train, a locomotive health system configured to output one or more health signals indicative of a health status of each of the plurality of locomotives, and an energy management system in electronic communication with the signaling system onboard component and the locomotive health system. The energy management system may be configured to generate driving command signals based on the RTA and the one or more health signals, generate an RTA confirmation signal based on the one or more health signals, the RTA confirmation signal being indicative of whether the train will achieve the RTA, and communicate the RTA confirmation signal to a train signaling system via the signaling system onboard component.

20 Claims, 4 Drawing Sheets

LOCOMOTIVE HEALTH-BASED TRAIN PACING SYSTEM

TECHNICAL FIELD

The present disclosure relates generally to a train control system and, more particularly, to a locomotive health-based train pacing system.

BACKGROUND

Railroad networks facilitate many freight delivery missions between numerous origins and destinations on a daily basis. Each delivery mission typically has a predetermined delivery route, and multiple trains are often required to share portions of track that are common to their respective delivery routes. Accordingly, railroad network administrators must schedule train traffic on the railroad network to allow each train to complete its respective delivery mission within a particular time window while minimizing downtime and preventing possible collisions with other trains. Train traffic on a railroad network is typically scheduled for a given period of time (e.g., per day) based on known quantities of freight that need to be moved from each origin to each destination. Based on this information, each train is given an estimated time of arrival (ETA) by which it should reach its destination to ensure portions of track shared with other trains will be clear at appropriate times. It is then the responsibility of train operators and/or an operating system, with the assistance of train protection signaling systems, to ensure that each train arrives at its destination by the ETA.

In general, the manner in which a train reaches its destination by the ETA is controlled by locomotive operators and/or a locomotive control system. For instance, operators may control locomotives with certain throttle and braking command strategies in order to allow the train to reach its destination by the ETA. Such command strategies often also include additional goals of optimizing certain operational aspects, such as fuel efficiency, emissions, and locomotive protection, which can affect when a train reaches its destination. And in some situations, such as when a locomotive experiences a fault that requires it to operate at reduced power levels, delays in reaching the destination may be unavoidable, which can delay the operations of other trains on the railroad network and frustrate the overall network schedule developed by the railroad network administrators.

A method of generating and executing a trip plan for a train is described in U.S. Pat. No. 8,630,757 to Daum et al. that issued on Jan. 14, 2014 ("the '757 patent"). Specifically, the method described in the '757 patent includes receiving original objectives (e.g., arrival time) from a dispatch center and communicating the original objectives to a train control system. An optimal trip plan is then generated by the train control system, whereby the train control system determines operating parameters, such as speed and power, that optimize performance factors, such as fuel consumption and emissions within the constraints of the original objectives. The train control system then generates control commands according to the trip plan to carry out a mission. During the mission, the train control system receives input indicative of current train performance capabilities, such as train health factors and whether the train is going to reach its destination by the arrival time. Based on the input, the train control system regenerates the trip plan for achieving the original objectives with optimum operating parameters in view of current performance capabilities.

While the method disclosed in the '757 patent may be somewhat effective for regenerating trip plans and control strategies for a locomotive based on performance feedback of the locomotive, it may not be optimum. For example, when a train is behind schedule, the method of the '757 patent may require train operators to manually enter delay information to be communicated to the dispatch center or to other trains on the network for recalculating their trip plans. As a result, the timeliness and accuracy of the operators input can affect the efficacy of regenerating a trip plan or changing an objective. Further, the method of the '757 patent may only addresses trip plan or objective modifications with respect to the performance of a lead locomotive or lead consist and may not account for other important aspects of train performance.

The disclosed train pacing control system is directed to overcoming one or more of the problems set forth above.

SUMMARY

In one aspect, the present disclosure is directed to a system for pacing a train having a plurality of locomotives. The system may include an signaling system onboard component configured to receive a signal indicative of a requested time of arrival (RTA) of the train, a locomotive health system configured to output one or more health signals indicative of a health status of each of the plurality of locomotives, and an energy management system in electronic communication with the signaling system onboard component and the locomotive health system. The energy management system may be configured to generate driving command signals based on the RTA and the one or more health signals, generate an RTA confirmation signal based on the one or more health signals, the RTA confirmation signal being indicative of whether the train will achieve the RTA, and communicate the RTA confirmation signal to a train signaling system via the signaling system onboard component.

In another aspect, the present disclosure is directed to a method of pacing a train having a plurality of locomotives. The method may include receiving a signal indicative of a requested time of arrival (RTA) of the train, receiving one or more health signals indicative of a health status of each of the plurality of locomotives, generating driving command signals based on the RTA and the one or more health signals, generating an RTA confirmation signal based on the one or more health signals, the RTA confirmation signal being indicative of whether the train will achieve the RTA, and communicating the RTA confirmation signal to a train signaling system.

In yet another aspect, the present disclosure is directed to a system for pacing a train having a plurality of locomotives. The system may include an signaling system onboard component configured to receive a signal indicative of a requested time of arrival (RTA) of the train and a locomotive health system having a heath tracking system. The health tracking system may be configured to receive health information from each of the plurality of locomotives, determine a health status of each of the plurality of locomotives, determine an estimated time of arrival (ETA) of the train based on the health status of each of the plurality of locomotives, and communicate the ETA to a train signaling system. The system may further include an energy management system in electronic communication with the signaling system onboard component and the locomotive health system. The energy management system may be configured to generate an RTA confirmation signal based on the one or more health signals, the RTA confirmation signal being indicative of whether the train will achieve the RTA, communicate the RTA confirmation signal to a train signaling system via the signaling system onboard component, receive a signal from the train signaling system indicative of an updated RTA via the signaling system onboard component, and generate driving command signals based on the updated RTA.

DETAILED DESCRIPTION

Figure 1:
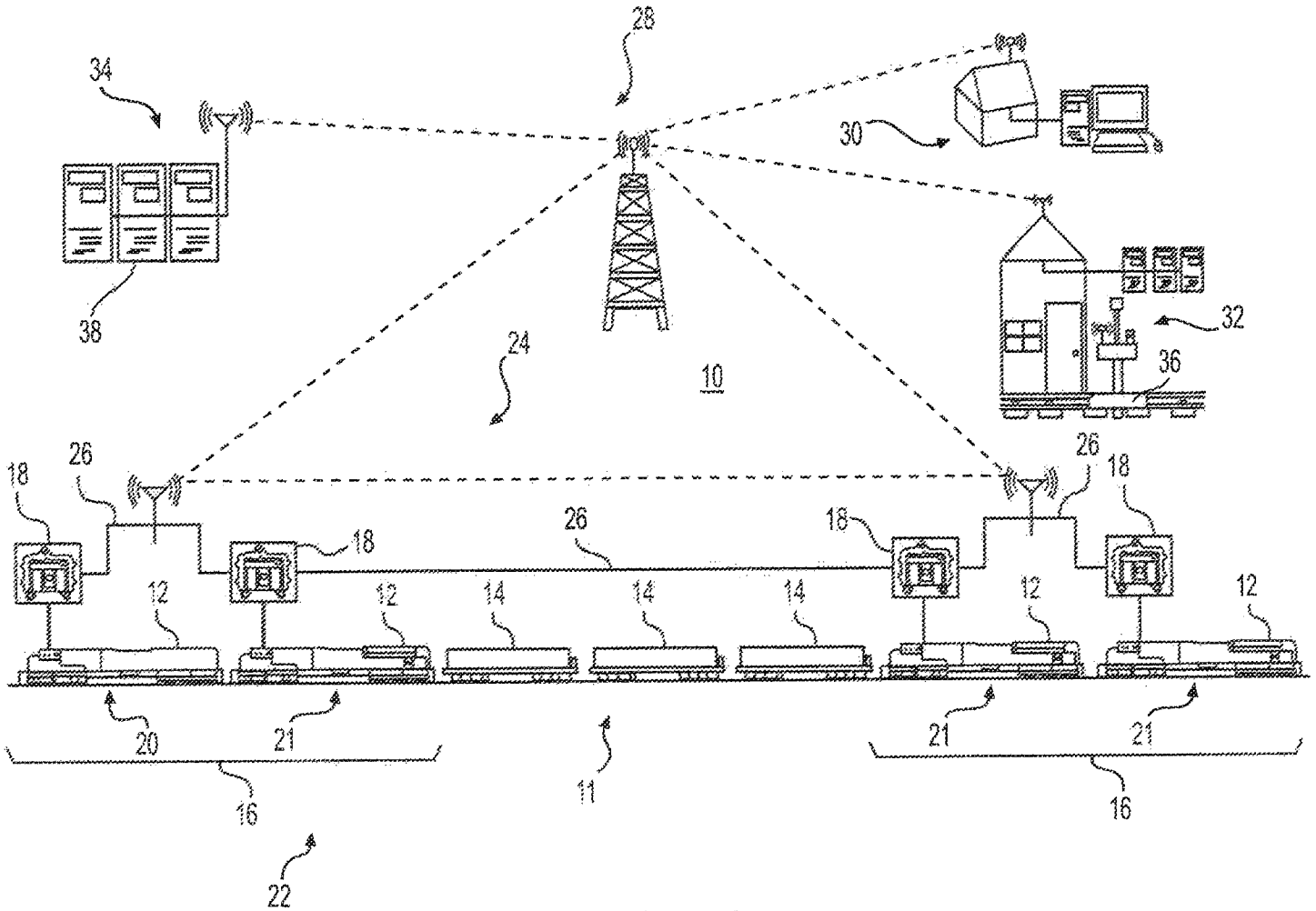
FIG. 1 is a schematic illustration of an exemplary pacing system for a train.

FIG. 1 illustrates an exemplary train pacing system 10 that may be used pace one or more trains 11 (only one train 11 shown) on a railroad network. Train 11 may include a plurality of coupled rolling stock assets including a plurality of locomotives 12 and a plurality of cars 14. Cars 14 may include, for example, freight cars, tender cars, passenger cars, tanker cars, and/or other types of cars that can be pulled by a train. It is understood that other types of rolling stock assets may be included.

Train 11 may include one or more locomotive consists 16. Each consist 16 may include two or more locomotives 12 directly coupled to each other (i.e., without any intervening cars 14). Consists may be positioned at various locations throughout train 11, such as in a front of train 11 (i.e., ahead of all other rolling stock assets), at an end of train 11 (i.e., behind all other rolling stock assets), or in the middle of train 11 (i.e., between other rolling stock assets).

Locomotives 12 in each consist 16 may be connected to an adjacent locomotive 12 in several different ways. For example, locomotives 12 may be connected to each other via a mechanical coupling, one or more fluid couplings, and one or more electrical couplings for transmitting power and/or data (e.g., data in the form of electrical signals). In one example, the electrical couplings include a multiple-unit (MU) cable configured to transmit conventional command signals and/or electrical power. In another example, the electrical couplings include a dedicated data link configured to transmit packets of data (e.g., Ethernet data). In yet another example, the data packets may be transmitted via the MU cable. It is also contemplated that some data may be transmitted via a combination of the MU cable, the dedicated data link, and/or other means (e.g., wirelessly), if desired.

Each of the plurality of locomotives 12 may include a locomotive control system 18 configured to control a plurality of locomotive configuration settings and other operational aspects. For instance, each locomotive control system may facilitate manual and/or automatic control of a respective one of the plurality of locomotives 12. To facilitate coordinated control of the plurality of locomotives 12 throughout train 11, one of the locomotives may be designated as a lead locomotive 20 and the rest may be designated as trail locomotives 21. The consist 16 to which lead locomotive 20 belongs may be designated as a lead consist 22. In some situations, lead consist 22 may be the first consist 16 of train 11 with respect to the directions of travel. In other situations, lead consist 22 may alternatively be in the middle or at the end of train 11. Similarly, lead locomotive 20 may initially be the first locomotive of lead consist 22. In some situations, lead locomotive 20 be initially be in the middle (e.g., when consist 22 includes more than two locomotives) or end of consist 22.

Lead locomotive 20 may be configured to control and/or provide input signals to the trail locomotives 21 based on commands generated by an operator or an automatic train operation (ATO) system associated with control system 18 of lead locomotive 20. That is, in addition to controlling operations of lead locomotive 20, the control system 18 of lead locomotive 20 may also be configured to control operations of trail locomotives 21. Lead locomotive 20 may control trail locomotives 21 by transmitting operational commands that are the same as or based on operational commands generated for controlling lead locomotive 20. Operational commands may be transmitted from lead locomotive 20 to other locomotives 12 through an onboard communication network 24.

Onboard communication network 24 may include wired connections 26 between locomotives of the same consist. In some embodiments, wired connections 26 may include electrical connections that are part of the coupling between adjacent locomotives 12. For example, onboard communication network may be or include a portion of an electronically controlled pneumatic brake (ECPB) system. Onboard communication network 24 may also or alternatively include a wireless communication system 28 that is configured to communicate information among locomotives 12 in the same or different consists 16. In other embodiments, onboard communication network 24 may include only wired connections 26 or only wireless communication system 28. Wireless communication system 28 may include hardware and/or software configured to provide wireless communication throughout train 11. For example, wireless communication system 28 may utilize WiFi, Bluetooth, cellular, RFID, and/or other wireless communication technologies.

Train 11 may also be configured to communicate with components of a railroad network, such as a railroad network scheduling system ("scheduling system") 30, an automatic train protection (ATP) signaling system ("signaling system") 32, and/or a locomotive health tracking system ("health tracking system") 34. Scheduling system 30 may be used to plan train traffic schedules for the railroad network over given periods of time (e.g., daily, weekly, monthly, etc.). Signaling system 32 may be configured to generate and communicate signals to train 11 that are based on the traffic schedule and indicative where and when train 11 is permitted to travel to avoid other trains on the network. As explained in further detail below, signaling system 32 may generate signals based further on a health status of each locomotive 12, which, in some embodiments, may be determined by health tracking system 34.

Scheduling system 30 may be a computerized system configured to facilitate the organization and scheduling of trains and payloads on the railroad network. For example, personnel may use scheduling system to plan origin and destination locations for delivery missions, time constraints for completing all or a part of each mission, and specific routs for trains to travel from the origin to the destination. Origins and destinations may be expressed as coordinate locations (e.g., GPS locations) or other characteristics (e.g., an address, a location name, etc.) associated with an origin or destination. Scheduling system 30 may be configured to receive manual entries of scheduling input from a user (e.g., via an interface device of a computer) and/or automatically receive scheduling input from other electronic devices (e.g., trains, signaling system 32, inventory systems, shipment tracking systems, etc.).

Scheduling input may include, for example, quantities of payloads to be delivered (e.g., raw materials, products, passengers, etc.), locations associated with payloads, (e.g., origin location, destination location, current location, etc.), possible delivery routes, desired delivery routes, sections of track that are open or closed, and dates and times at which payloads are required to be picked up or delivered at certain locations. A time at which a train is required to arrive at a certain location to pick up or deliver its payload may be referred to as a requested time of arrival (RTA). Scheduling system 30 may be used to plan initial railroad traffic schedules that allow each train to arrive at each location at its associated RTA while taking into consideration train and network parameters (e.g., a number of trains on the network, train length, loading/unloading time, open/closed stretches of track, yard capacity, etc.).

Signaling system 32 may be configured to track the location and certain travel parameters of each train on the railroad network as they travel from one location to another, and provide signals to train operators or train control systems indicative of when to proceed and when to stop. In this way, signaling system 32 may be configured to regulate train traffic on the railroad network to facilitate the use of the network by multiple trains that share portions of track along their respective delivery routes. Signaling system 32 may track certain parameters, such as speed, distance traveled, distance between known locations (e.g., checkpoints, yards, switches, sidings, etc.), and/or other parameters for each train on the network.

For example, signaling system 32 may include a plurality of transponders 36 positioned between or beside the rails along stretches of track throughout the railroad network. Transponders 36 may be configured to communicate data, instructions, and other signals with corresponding transponders located on each train. For example, transponders 36 may include magnetic devices, electromagnetic devices, optical devices, radio devices, and or other types of communication devices configured to send and receive information. Transponders 36 may be configured to detect the presence of each train that passes, and a signaling system computer 38 may be configured to determine certain travel parameters based on signals received from one or more transponders 36 and/or other known information. For instance, signaling system computer 38 may be configured to determine the speed and location of each train based on when each transponder 36 detects a train and the distance between each transponder. In other embodiments, transponders 36 may receive a signal from the passing train indicative of sensed data, such as a speed sensor reading, a location signal (e.g., GPS), or other information.

Signaling system 32 may be configured to use the information gathered from transponders 36 and/or other known information to determine an estimated time of arrival (ETA) of each train at various locations in the railroad network. For instance, signaling system 32 may be configured to determine when each train will actually arrive at certain locations (e.g., switches, sidings, yards, ports, stations, etc.), regardless of the train's RTA at each location. That is, in some situations, a train's ETA may vary from its RTA when a train travels faster or slower than expected when the network schedule was generated using scheduling system 30. For instance, a train may be lighter, operate more efficiently, have a more experienced driver, etc., than anticipated, which can result in a train traveling faster than expected and arriving sooner at each location. On the other hand, a train may be heavier, less efficient, experience a malfunction, encounter a delay (e.g., a delayed arrival of materials as port, delayed fuel delivery, etc.), or have a less experienced driver, etc., which can result in slower and/or delayed travel. Based on the ETA determined for each train, and thereby accounting for any unexpected advances or delays in travel, signaling system 32 may be configured to determine and communicate an updated RTA for each train that allows each train to continue its mission with minimal delay.

As mentioned above, certain information relevant to determining how quickly a train can travel from one location to another may not always accurate or available to scheduling system 30 or, moreover, may change in the middle of a mission, thereby affecting a trains ETA. In particular, train performance factors, such as locomotive health, can decrease during a mission, which can cause a train to travel more slowly, require a lead change, or otherwise result in delayed operations. And known signaling systems may not be able to detect on their own the health status of each locomotive 12 in train 11 for purposes of more accurately determining the ETA or updated RTA of train 11. To more accurately determine the updated RTA for train 11, locomotive health information may be aggregated and used to more accurately determine the ETA of train 11, which may then be provided to signaling system 32 for more accurately determining the updated RTA. Locomotive health information usable for more accurately determining the ETA of train 11 may be gathered from existing systems and equipment on each locomotive 12.

Figure 2:
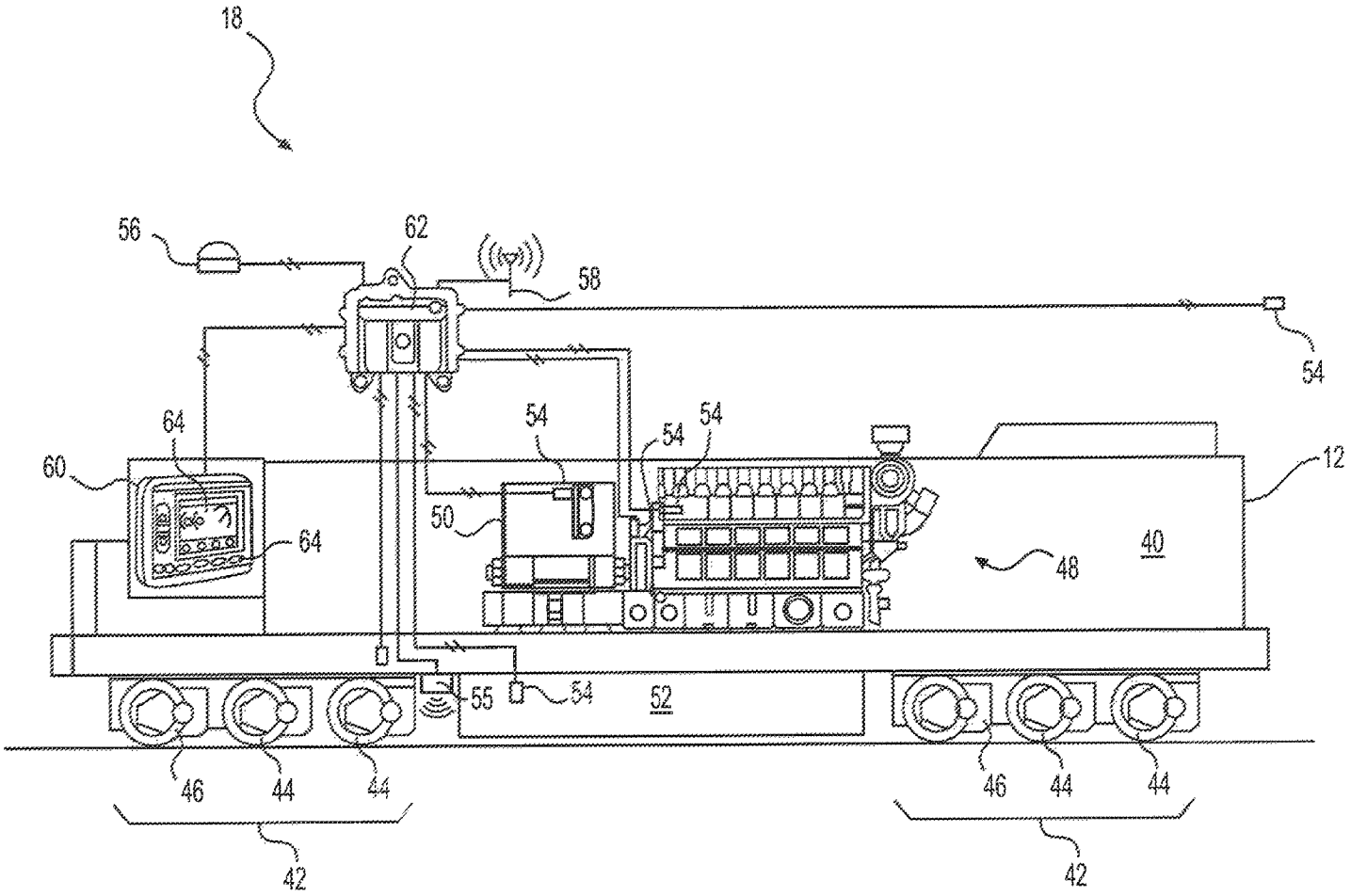
FIG. 2 is a schematic illustration of an exemplary locomotive that may be included in the train of FIG. 1.

FIG. 2 shows a schematic diagram of control system 18 and related equipment of locomotive 12. As shown in FIG. 2, each locomotive 12 may include a car body 40 supported at opposing ends by a plurality of trucks 42 (e.g., two trucks 42). Each truck 42 may be configured to engage railroad tracks via a plurality of wheels 44, and to support car body 40. Each truck 42 may have two or more axles that are each configured to rigidly support wheels 44 at opposing ends thereof, such that wheels 44 and the axles rotate together. A traction motor 46 may be disposed at a lengthwise center of each axle, connected to an associated truck 42, and configured to drive paired wheels 44 via the axle.

Any number of engines 48 may be mounted to car body 40 and drivingly connected to a generator 50 to produce electricity that propels wheels 44 of each truck 42 via traction motors 46. Engines 48 may be internal combustion engines configured to combust a mixture of air and fuel. The fuel may include a liquid fuel (e.g., diesel) provided to engines 48 from a tank 52 located onboard each locomotive 12, a gaseous fuel (e.g., natural gas) provided by a tender car via fluid couplings, and/or a blended mixture of the liquid and gaseous fuels.

As also shown in FIG. 2, locomotive control system ("control system") 18 may include a network of components configured to monitor operating parameters of locomotive 12 and facilitate manual and/or automatic control of locomotive 12. Control system 18 may include, among other things, at least one sensor 54, a signaling system onboard component 55, a locating device 56, a communicating device 58, a control panel 60, and a controller 62 electrically connected with the other components of control system 18. Signals generated by sensors 54, locating device 56, communicating device 58, and/or control panel 60 may be processed by controller 62 and communicated to an operator of locomotive 12 for manual control or utilized by controller 62 to automatically control operations of locomotive 12.

Any number of sensors 54 may be included within control system 18, each being configured to generate operational data associated with a component of train 11. For example, one or more of sensors 54 could be associated with engine 48 and configured to monitor engine parameters, such as a cylinder pressure, an oil pressure, a fuel pressure, a water temperature, an exhaust temperature, an intake air pressure or temperature, a speed, a vibration level, etc., and to generate corresponding signals. In another example, one or more of sensors 54 could be associated with each traction motor 46, with each wheel 44 (e.g., with a bearing of each wheel 44), with generator 50, with tank 52, with coupling components, etc., and configured to generate corresponding pressure signals, temperature signals, speed signals, position signals, or other types of signals indicative of the performances or states of the associated components. When values of the signals generated by sensors 54 deviate from expected values or ranges, the signals may be correlated to a status of the associated component. For example, when the value of a particular signal exceeds or falls below a corresponding threshold value, the associated components may be determined to be malfunctioning. The signals generated by sensors 54 may be directed to controller 62 for further processing.

Signaling system onboard component 55 may be a transponder or other type of communication device configured to communicate data and/or other information with signaling system 32 via transponders 36. Signaling system onboard component 55 may include one or more of magnetic devices, electromagnetic devices, optical devices, radio devices, and or other types of communication devices configured to send and receive information. Signaling system onboard component 55 may be configured to communicate any information stored, received, or processed by controller 62.

Locating device 56 may be configured to generate signals indicative of a geographical position and/or orientation of train 11 relative to a local reference point, a coordinate system associated with a region, a coordinate system associated with Earth, or any other type of 2-D or 3-D coordinate system. For example, locating device 56 may en/body an electronic receiver configured to communicate with satellites or with a local radio or laser transmitting system and to determine a relative geographical location of itself. Locating device 56 may receive and analyze high-frequency, low-power radio or laser signals from multiple locations to triangulate a relative 3-D geographical position and orientation. Signals generated by locating device 56 may be directed to controller 62 for further processing.

Communicating device 58 may be configured to facilitate data communication between different components (e.g., between sensors 54 and controller 62, between controller 62 and control panel 60, and/or between controller 62 and other components) of control system 18 or between components of control system 18 and entities off-board train 11 (e.g., scheduling system 30, signaling system 32, health tracking system 34, etc.). Communicating device 58 may also be configured to facilitate communication with other locomotives 12 of the same or a different consist 16 of train 11. Communicating device 58 may include hardware and/or software that enable the sending and/or receiving of data messages through a communications link. The communications link may include satellite, cellular, infrared, WiFi, Bluetooth, radio, or any other type of wireless communication technology. Alternatively, the communications link may include electrical, optical, or any other type of wired communications, if desired. In one embodiment, control panel 60 and/or controller 62 may be located off-board train 11, and may communicate directly with the other onboard components of control system 18 via communicating device 58, if desired. Other means of communication may also be possible.

Control panel 60 may be an interface system located at or near an operator station of locomotive 12 and configured to facilitate manual observation and control of locomotive 12. Control panel 60 may include one or more input devices 64 configured to receive user inputs for controlling operations of locomotive 12. Input device 64 may include one or more components, such as buttons, knobs, switches, dials, levers, touch-screens, soft keys, a keyboard, a mouse, and/or other components configured to allow a user to provide inputs to or operate an electronic device. In some embodiments, control panel 60 may include separate input devices 64 for controlling each of a plurality of operational settings associated with, for example, uncouplers, lights, brake systems, isolation functions, engine start and stop functions, distributed power functions, lead change functions, and/or other aspects.

Controller 62 may embody a single microprocessor or multiple microprocessors that include a means for operating and/or controlling control system 18 based on information obtained from any number of train components via sensors 54, from locating device 56, from communications received via communicating device 58, and/or from control panel 60. Numerous commercially available microprocessors can be configurable to perform the functions of controller 62. Controller 62 may include a memory, a secondary storage device, a processor, and any other components for running an application. The memory may include a non-transitory computer-readable medium, such as RAM, ROM, FLASH memory, CD ROM, magnetic devices (e.g., disks, tape, etc.), and/or other types of memory. Various other circuits may be associated with controller 62 such as power supply circuitry, signal conditioning circuitry, solenoid driver circuitry, and other types of circuitry.

In some embodiments, controller 62 may be configured to generate health information or determine the health status of locomotive 12 based on detected or otherwise determined operating parameters of locomotive 12. The health status of locomotive 12 may refer to a general condition of one or more components and/or systems of locomotive 12 (e.g., engine systems, braking systems, traction systems, etc.). The health status of locomotive 12 may reflect, relate to, or be indicative of the ability of locomotive 12 to achieve or operate at certain performance levels (e.g., certain power output level, certain throttle positions, certain speeds, etc.). Operating parameters that may be indicative of or contribute to a determination of the health status of locomotive 12 (i.e., health information) may include one or more of, for example, engine cylinder pressure, oil pressure, fuel pressure, water temperature, exhaust temperature, intake air pressure or temperature, speed, a vibration level, and/or other parameters that may be measured or determined and are indicative of a quality, suitability, or other aspect of performance. For example, parameters measured by sensors 54 may be indicative of or contribute to a determination of the health status of locomotive 12.

Figure 3:
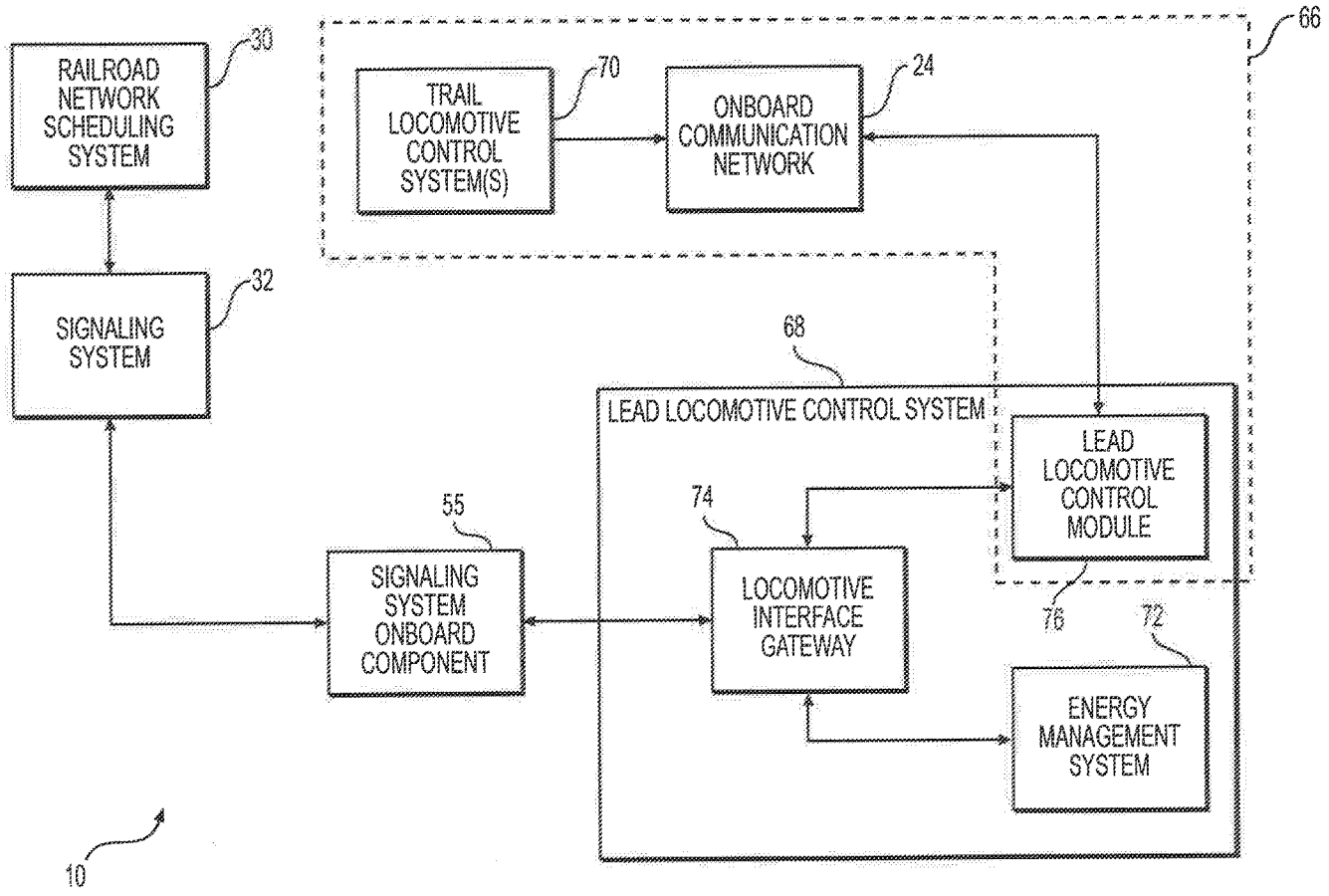
FIG. 3 is a diagrammatic illustration of a portion of the train pacing system of FIG. 1.

As shown in FIG. 3, train pacing system 10 may be configured to aggregate health status information from each locomotive 12 (i.e., lead and trail locomotives) via a locomotive health system ("health system") 66 and provide the health status information to a lead locomotive control system 68 and signaling system 32. Each trail locomotive 21 (referring to FIG. 1) may include a trail locomotive control system 70 configured to generate health information or determine the health status of a respective trail locomotive 21 and communicate the health information or status to lead locomotive control system 68 via onboard communication network 24 (e.g., an ECPB system). In this way, locomotive health system 66 may include lead and trail locomotive control systems 68, 70 as means for obtaining health information pertaining to each locomotive 12 of train 11. The health information and/or status of lead locomotive 20 and each trail locomotive 21 may be transmitted to an energy management system 72 of lead locomotive control system 68 via a locomotive interface gateway 74 for further processing. The health information and/or status of each trail locomotive 21 may also be transmitted to signaling system 32 via signaling system onboard component 55 for further processing.

Energy management system 72 may be a control module embedded within or in electronic communication with lead locomotive control system 68. As used herein, the term "module" may refer to hardware, software, or combinations thereof configured to store (e.g., via computer-readable medium) and/or execute (e.g., via a processor) computer-readable instructions. Energy management system 72 may be configured to generate command signals to optimize control of train 11 under given (i.e., currently detected) circumstances. Energy management system 72 may be configured to receive input signals from sensors 54, locating device 56, signaling system 32 (e.g., the RTA of train 11), and/or other inputs indicative of operating parameters of train 11 and generate output signals for achieving optimum control of train 11 (e.g., operations of lead locomotive 20 and trail locomotives 21) while achieving the specified RTA. For example, energy management system 72 may generate command signals for automatically controlling throttle, braking, and or other aspects of lead and trail locomotives 20, 21 based on the current operating parameters, health condition, and/or location of lead and trail locomotives 20, 21 in order to achieve optimum performance while accomplishing all mission goals and objectives. Mission goals and objectives may include achieving performance goals (e.g., performance levels, efficiency levels, etc.), adhering to schedules, and obeying laws (e.g., speed limits).

Command signals from energy management system 72 may be communicated to a lead locomotive control module 76 and trail locomotive control system(s) 70 for manual or automatic execution. For instance, the command signals may be displayed to a locomotive operator via a display on control panel 60, which the operator may use to manually control throttle, braking, and or other controls. In this way, the operator may be able to directly follow or modify as desired the driving strategy of energy management system 72. Alternatively, the command signals generated by energy management system 72 may be used by lead locomotive control module 76 for automatically actuating throttle, braking, and/or other controls of lead and trail locomotives 20, 21 according to the driving strategy associated with energy management system 72.

Based on the optimum command signals, energy management system 72 may also be configured to determine whether and to what extent train 11 will arrive sooner or later than its associated RTA. That is, based on the location of train 11 and the determined throttle, braking, and/or other commands for controlling lead and trail locomotives 20, 21, energy management system 72 may be configured to determine that train 11 will be early or late in arriving at its next destination with respect to the associated RTA. This information, along with the aggregated health information of lead and trail locomotives 20, 21 generated by locomotive health system 66 may be communicated to signaling system 32 via signaling system onboard component 55, which may be used by signaling system to determine an updated ETA of train 11. In this way, signaling system 32 may be provided with more detailed and more accurate information about whether and to what extent train 11 will arrive at its next location based on performance factors of locomotives 12 of train 11. Along with other information accessible to signaling system 32 (as discussed above), signaling system 32 may be able to more accurately determine the ETA of train 11 and share the ETA with scheduling system 30. By providing scheduling system 30 with updated ETA information for train 11, scheduling system 30 may be more effectively used to update or adjust the railroad network train schedule throughout the day or as operating conditions in the network change.

Additionally, by determining more accurate ETA information, signaling system 32 may be able to update and more accurately determine the RTA of train 11. With more accurate RTA information, energy management system 72 may be able to generate improved command signals for controlling lead and trail locomotives 20, 21, thereby improving the overall efficiency of train 11. Thus, energy management system 72 may benefit from both the aggregated health information generated by locomotive health system 66 as well as more accurate or updated RTA information from signaling system 32.

Figure 4:
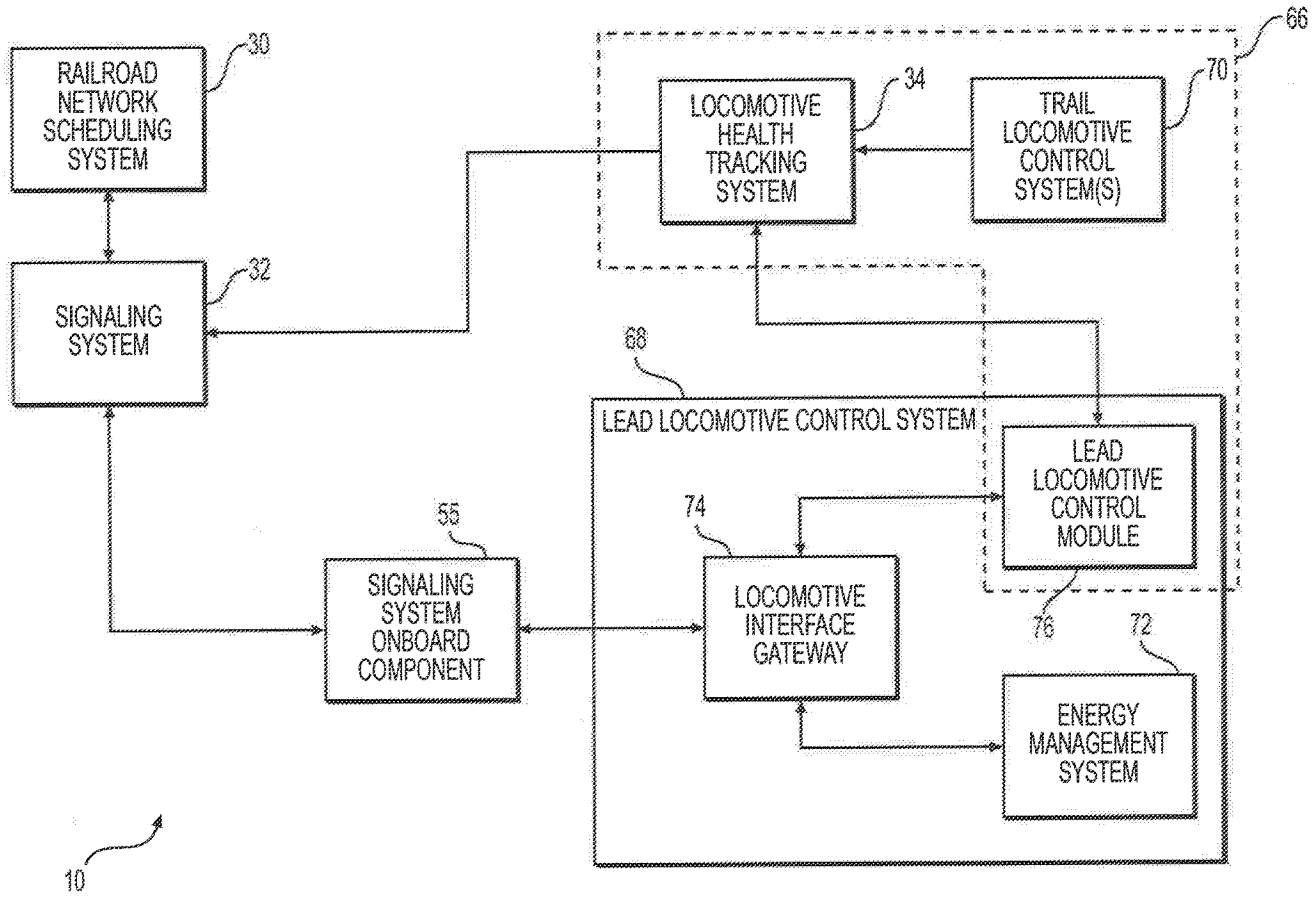
FIG. 4 is another diagrammatic illustration of a portion of the train pacing system of FIG. 1.

In other embodiments, as shown in FIG. 4, locomotive health system 66 may include locomotive health tracking system 34. In this configuration, lead and trail locomotive control systems 68, 70 may communicate heath information of locomotives 12 directly to locomotive health tracking system 34 (e.g., via communicating device 58) for dedicated processing and analysis of locomotive health information. In this way, health tracking system 34 may allow locomotive health information to be more easily accessed by personnel and computers located off-board train 11 that are better suited to perform continuous and high-speed analysis of greater amounts of data than may be possible with onboard computing systems or signaling system 32.

That is, locomotive health tracking system 34 may be configured to collect health information from locomotives 12 of train 11 and/or other trains on the railroad network and process the health information using dedicated computing hardware and software. For example, locomotive health tracking system 34 may be a cloud computing system or other type of data aggregation and analysis network. Locomotive health tracking system 34 may include one or more computers, servers, or other computing systems in electronic communication with each locomotive 12 via wireless communication system 28 (e.g., via communicating devices 58) and configured to facilitate manual or automatic analysis of locomotive health information. Based on the aggregated health information from each locomotive 12, locomotive health tracking system 34 maybe configured to determine the updated ETA of train 11 and other trains on the network and share the ETA with signaling system 32 and scheduling system 30.

For instance, along with the aggregated health information of locomotives 12, locomotive health tracking system 34 may be provided with other information accessible to lead and trail locomotive control systems 68, 70 (e.g., positioning information, scheduling information, RTA, etc.) and configured to determine more accurately the ETA of train 11. Using this information from train 11 and the other trains on the network, health tracking system 34 may be able to more accurately determine the ETA for each train on the network in real time with dedicated computing power and strategies. In this way, locomotive health tracking system 34 may provide signaling system 32 with updated and more accurate ETA information for each train on the network. Using this information, signaling system 32 may be able to provide more accurate and efficient RTA times to train 11 and the other trains on the network, even when unexpected delays (e.g., caused by shipping delays, deteriorated locomotive health, breakdowns etc.) occur throughout the day, week, or month. Additionally, the updated ETA information may also be shared with scheduling system 30, thereby allowing scheduling system 30 to be more effectively used to update or adjust the railroad network train schedule in real time.

INDUSTRIAL APPLICABILITY

The disclosed pacing system can be applicable to any train that includes multiple locomotives and is operated on a railroad network that services a plurality of trains. The disclosed pacing system may provide a way to aggregate health information of each locomotive in a given train, as well as of each train on the railroad network, to more accurately determine an updated ETA of each train at its next destination. The disclosed pacing system may share the updated information with an ATP signaling system and network scheduling system to allow for more efficient RTAs to be generated for each train on the network in real time. An exemplary operation of a pacing system consistent with the present disclosure will now be discussed.

Scheduling system 30 may be used to manually or automatically generate a traffic plan for the railroad network. The schedule may include initial or original RTA information for each train with respect to location along its respective delivery route. The schedule and RTA information for each train may be shared with signaling system 32, which may apply and/or adjust the RTA of each train in order to more efficiently utilize track space and/or other resources shared by the multiple trains on the network.

For example, signaling system 32 may transmit RTA information to lead locomotive control system 68 via signaling system onboard component 55. The RTA information may be directed to energy management system 72, which may use the RTA information, along with aggregated health information of each locomotive (i.e., lead and trail locomotives 20, 21) of train 11 from health system 66, to generate optimum driving commands for each locomotive 12. Lead locomotive control module 76 may automatically execute the driving commands (or allow an operator to manually execute the driving commands) to control the operations of locomotives 12 according to the driving strategy of energy management system 72. Based on the aggregated health information and the driving strategy, energy management system 72 may then determine whether and to what extent train 11 will arrive sooner or later than its assigned RTA.

The aggregated health information and RTA determination may then be used by health tracking system 34 or signaling system 32 to determine an updated ETA of train 11. For instance, the aggregated health information from lead and trail locomotive control systems 68, 70 may be collected by lead locomotive 20 and communicated to signaling system 32 via signaling system onboard component 55 for determining the updated ETA of train 11. Alternatively, the health information generated by each locomotive may be directly communicated to health tracking system 34 for determining the updated ETA of train 11, which may then be communicated to signaling system 32. With the updated ETA information, signaling system may be able to determine updated RTA information for each train on the network that accounts for the health status of each locomotive of the respective train. That is, based on the aggregated health information of each locomotive 12 (i.e., lead and trail locomotives 20, 21), more accurate ETAs and updated RTAs may be generated for each train in the network, thereby improving the overall efficiency of the network.

It will be apparent to those skilled in the art that various modifications and variations can be made to the disclosed pacing system without departing from the scope of the disclosure. Other embodiments of the disclosed pacing system will be apparent to those skilled in the art from consideration of the specification and practice of the pacing system disclosed herein. It is intended that the specification and examples be considered as exemplary only, with a true scope being indicated by the following claims and their equivalents.

What is claimed is:

1. A system for pacing a train having a plurality of locomotives, comprising:

an signaling system onboard component configured to receive a signal indicative of a requested time of arrival (RTA) of the train;

a locomotive health system configured to:

aggregate health status information associated with each locomotive of the plurality of locomotives; and output one or more health signals indicative of a health status of each of the plurality of locomotives, the one or more health signals is based on the aggregated health status information;

an energy management system in electronic communication with the signaling system onboard component and the locomotive health system, and being configured to:

generate driving command signals based on the RTA and the one or more health signals;

generate an RTA confirmation signal based on the one or more health signals, the RTA confirmation signal being indicative of whether the train will achieve the RTA; and communicate the RTA confirmation signal to a train signaling system via the signaling system onboard component.

2. The system of claim 1, wherein:

the plurality of locomotives includes a lead locomotive and one or more trail locomotives; and the one or more health signals are indicative of a health status of each of the one or more trail locomotives.

3. The system of claim 1, wherein the locomotive health system includes a health tracking system configured to receive health information from each of the plurality of locomotives and determine a health status of each of the plurality of locomotives.

4. The system of claim 3, wherein the health tracking system is an off-board computer system configured to communicate separately with each of the plurality of locomotives.

5. The system of claim 3, wherein the health tracking system is configured to determine an estimated time of arrival (ETA) of the train based on the health status of each of the plurality of locomotives.

6. The system of claim 5, wherein the signaling system onboard component is configured to receive a signal from the train signaling system indicative of an updated RTA, the updated RTA being based on the ETA.

7. The system of claim 1, wherein the locomotive health system includes an onboard communication network configured to communicate health information from each trail locomotive to the train signaling system via the signaling system onboard component.

8. The system of claim 7, wherein the onboard communication network is an electronically controlled pneumatic brake system.

9. The system of claim 7, wherein the energy management system is configured to receive a signal from the train signaling system indicative of an updated RTA via the signaling system onboard component.

10. The system of claim 9, wherein the updated RTA is based on an estimated time of arrival (ETA) determined by the train signaling system based at least in part on the health information from each trail locomotive.

11. A method of pacing a train having a plurality of locomotives, comprising:

receiving a signal indicative of a requested time of arrival (RTA) of the train;

aggregating health status information associated with each locomotive of the plurality of locomotives;

receiving one or more health signals indicative of a health status of each of the plurality of locomotives, the one or more health signals is based on the aggregated health status information;

generating driving command signals based on the RTA and the one or more health signals;

generating an RTA confirmation signal based on the one or more health signals, the RTA confirmation signal being indicative of whether the train will achieve the RTA; and communicating the RTA confirmation signal to a train signaling system.

12. The method of claim 11, wherein:

the plurality of locomotives includes a lead locomotive and one or more trail locomotives; and the one or more health signals are indicative of a health status of each of the one or more trail locomotives.

13. The method of claim 11, wherein the one or more health signals are received by an off-board computer system configured to communicate separately with each of the plurality of locomotives.

14. The method of claim 13, further including determining an estimated time of arrival (ETA) of the train based on the health status of each of the plurality of locomotives.

15. The method of claim 14, further including receive a signal from the train signaling system indicative of an updated RTA, the updated RTA being based on the ETA.

16. The method of claim 11, wherein the one or more health signals are received via an onboard communication network configured to communicate health information from each trail locomotive to the train signaling system.

17. The method of claim 16, wherein the onboard communication network is an electronically controlled pneumatic brake system.

18. The method of claim 16, further including receive a signal from the train signaling system indicative of an updated RTA.

19. The method of claim 18, wherein the updated RTA is based on an estimated time of arrival (ETA) determined by the train signaling system based at least in part on the health information from each trail locomotive.

20. A system for pacing a train having a plurality of locomotives, comprising:

an signaling system onboard component configured to receive a signal indicative of a requested time of arrival (RTA) of the train;

a locomotive health system having a health tracking system configured to:

aggregate health status information associated with each locomotive of the plurality of locomotives;

receive health information from each of the plurality of locomotives and determine a health status of each of the plurality of locomotives based on the aggregated health status information;

determine an estimated time of arrival (ETA) of the train based on the health status of each of the plurality of locomotives; and communicate the ETA to a train signaling system;

an energy management system in electronic communication with the signaling system onboard component and the locomotive health system, and being configured to:

generate an RTA confirmation signal based on the one or more health signals, the RTA confirmation signal being indicative of whether the train will achieve the RTA;

communicate the RTA confirmation signal to a train signaling system via the signaling system onboard component;

receive a signal from the train signaling system indicative of an updated RTA via the signaling system onboard component; and generate driving command signals based on the updated RTA.

* * * * *